US010240458B2

(12) United States Patent
Barnett et al.

(10) Patent No.: US 10,240,458 B2
(45) Date of Patent: Mar. 26, 2019

(54) TELESCOPIC PUMPABLE PROP ASSEMBLY WITH IMPROVED CEILING IMPACT PROPERTIES

(71) Applicant: Cougar Can Company Pty Ltd, New South Wales (AU)

(72) Inventors: Craig Douglas Barnett, New South Wales (AU); Phillip Martin Pike, New South Wales (AU)

(73) Assignee: Cougar Can Company PTY LTD, New South Wales (AU)

( * ) Notice: Subject to any disclaimer, the term of this patent is extended or adjusted under 35 U.S.C. 154(b) by 0 days.

(21) Appl. No.: 15/307,109

(22) PCT Filed: Apr. 28, 2015

(86) PCT No.: PCT/AU2015/000250
§ 371 (c)(1),
(2) Date: Oct. 27, 2016

(87) PCT Pub. No.: WO2015/164909
PCT Pub. Date: Nov. 5, 2015

(65) Prior Publication Data

US 2017/0044897 A1 Feb. 16, 2017

(30) Foreign Application Priority Data

Apr. 28, 2014 (AU) ..... 2014901515

(51) Int. Cl.
*E21D 15/55* (2006.01)
*E21D 23/00* (2006.01)
(Continued)

(52) U.S. Cl.
CPC ..... *E21D 15/18* (2013.01); *E04G 25/04* (2013.01); *E21D 15/16* (2013.01); *E21D 15/48* (2013.01); *E04G 2025/047* (2013.01)

(58) Field of Classification Search
CPC ..... E21D 15/55; E21D 15/483; E21D 15/545; E21D 23/00; E21D 23/0418;
(Continued)

(56) References Cited

U.S. PATENT DOCUMENTS 1,928,368 A * 9/1933 Coffey ..... B60S 9/12 254/423
2,145,847 A * 2/1939 Carpenter ..... B60S 9/12 254/423
(Continued)

FOREIGN PATENT DOCUMENTS

WO WO2004/053294 A1 6/2004
WO WO2011/133798 A1 10/2011
WO WO2012/016272 A1 2/2012

OTHER PUBLICATIONS

International Search Report and Written Opinion of the International Searching Authority, dated Jul. 1, 2015, for corresponding International Application No. PCT/AU2015/000250, 11 pages.

*Primary Examiner* — Benjamin F Fiorello
*Assistant Examiner* — Edwin J Toledo-Duran
(74) *Attorney, Agent, or Firm* — Klarquist Sparkman, LLP

(57) ABSTRACT

A grout tillable prop assembly for supporting a ceiling such as the ceiling of an underground mine. The prop assembly comprising an inner member and an outer member adapted for movement between an extended use configuration and a retracted configuration, a unidirectional grout inlet in an upper part of a sidewall of the outer member to allow grout to pass into the prop, the inner member and the outer member having wall portions and being self-supporting, an air conduit through the prop having an opening adjacent an upper limit of the prop, a pressure relief valve coupled to the air conduit whereby the prop is be brought from the retracted configuration to the extended configuration by application of
(Continued)

pressurized air through the air conduit and whereby the extended prop is filled with grout via the unidirectional grout inlet.

16 Claims, 8 Drawing Sheets

(51) Int. Cl.
*E21D 23/08* (2006.01)
*E21D 23/16* (2006.01)
*E21D 15/18* (2006.01)
*E04G 25/04* (2006.01)
*E21D 15/16* (2006.01)
*E21D 15/48* (2006.01)

(58) Field of Classification Search
CPC . E21D 23/063; E21D 23/066; E21D 23/0034; E21D 23/081; E21D 23/088; E21D 23/10; E21D 23/12; E21D 21/0086; E21D 15/00; B66F 5/025; E04G 25/00; E04G 25/04; F01B 7/02; F01B 7/20; F01B 15/00; F01B 2170/0458; F03C 1/02
USPC .... 405/288, 290, 291, 292, 293, 294, 302.1; 248/351–362; 254/50.1–50.4, 418–427; 91/170 MP, 171–195
See application file for complete search history.

(56) References Cited

U.S. PATENT DOCUMENTS

RE24,982 E * 5/1961 Schring ..... A61B 6/4464 248/333
3,164,066 A * 1/1965 Fryc ..... E21D 23/0069 91/170 MP
3,192,722 A * 7/1965 Herrmann ..... E21D 23/0047 405/297
3,589,682 A * 6/1971 Dickey ..... E04G 21/3233 256/59
3,601,996 A * 8/1971 Levy ..... E04G 11/02 248/357
3,986,697 A * 10/1976 Amor, Jr. ..... A61B 6/4464 248/333
4,041,714 A * 8/1977 Allen ..... E21D 23/0004 248/357
4,185,940 A * 1/1980 Spies ..... E21D 15/02 248/354.1
4,191,497 A * 3/1980 Poklekowski ..... E21D 23/0034 405/291
4,249,837 A 2/1981 Spies
4,274,764 A * 6/1981 Curry ..... E21D 23/0418 405/291
4,332,512 A * 6/1982 Heintzmann ..... E21D 15/585 248/354.1
4,391,469 A * 7/1983 Arsuaga ..... E21D 23/0082 299/11
4,676,697 A * 6/1987 Stafford ..... E21D 23/0086 175/219
5,088,385 A * 2/1992 McKee ..... F01B 7/20 277/439
5,143,340 A * 9/1992 Wood ..... E04G 21/0472 248/354.2
5,370,427 A * 12/1994 Hoelle ..... F16L 27/11 285/226
5,413,436 A * 5/1995 Merz ..... E21D 15/18 248/354.2
5,921,718 A * 7/1999 Kolk ..... E21D 15/18 248/354.2
6,209,440 B1 * 4/2001 Dannehl ..... E21D 15/44 91/168
6,394,707 B1 * 5/2002 Kennedy ..... E04G 21/0472 405/288
7,296,784 B2 * 11/2007 Peter ..... B60S 9/12 254/418
8,209,911 B2 * 7/2012 Welch ..... E21D 15/483 52/2.21
9,140,026 B2 * 9/2015 Barnett ..... E21D 15/445
2002/0109052 A1 * 8/2002 Jeon ..... A47C 3/30 248/161
2006/0193201 A1 * 8/2006 Schnipke ..... B01F 7/001 366/331
2007/0267559 A1 * 11/2007 Spearing ..... E21D 15/43 248/354.1
2011/0262231 A1 * 10/2011 Hussey ..... E21D 15/483 405/289
2012/0148350 A1 * 6/2012 Poulson ..... E21D 15/20 405/290
2013/0149044 A1 * 6/2013 Barnett ..... E21D 15/48 405/291
2014/0064859 A1 * 3/2014 Shook ..... E21D 15/18 405/290
2014/0224290 A1 * 8/2014 Shiraishi ..... E04H 15/48 135/121
2015/0290058 A1 * 10/2015 Panzer ..... B66F 3/28 403/109.6

* cited by examiner (Detail A)

TELESCOPIC PUMPABLE PROP ASSEMBLY WITH IMPROVED CEILING IMPACT PROPERTIES

CROSS REFERENCE TO RELATED APPLICATIONS

This is the U.S. National Stage of International Application No. PCT/AU2015/000250, filed Apr. 28, 2015, which in turn claims the benefit of and priority to Australian Patent Application No. 2014901515, filed Apr. 28, 2014.

TECHNICAL FIELD

The present invention is directed to improvements in relation to telescopic props that can be filled (pumped) with grout and which have particular use in underground mining.

BACKGROUND

The discussion of any prior art documents, techniques, methods or apparatus is not to be taken to constitute any admission or evidence that such prior art forms, or ever formed, part of the common general knowledge.

Pumpable props are elongate hollow members that can be filled (pumped) with a settable material such as grout to form a strong load bearing column. It is known for these props to be length adjustable.

A known type of pumpable prop is described in international patent publication WO 2012/016272 by inventor Craig Douglas Barnett. This prop acts as a secondary roof support structure in an environment such as an underground mine.

It has been found that it may be desirable to top off a secondary roof support system, such as one embodiment of the previously described prop, with members such as pieces of timber which are interposed between the top of the prop and the mine ceiling. The use of timber members (or other suitable structures) in this manner will typically "soften" the support response due to the contact compatibility of the timbers with the uneven roof, requiring wedges or small pieces of wood to provide a tight fit. A desirable consequence of the softened support response is that roof convergence can then occur with minimal loss of integrity. In addition, poor construction practices, in which multiple timber layers are placed on top of the roof support system, may provide hinge points that can also reduce the overall stability of the support. When less than full secondary roof support system contact with the roof is achieved, the wood response alone can result in a softening response which delaminates the strata in the roof mine and, very undesirably, weakens its integrity.

It is an object of the present invention to address one or more of the above-described problems or to at least provide a useful alternative to those props and stays that have hitherto been known in the prior art.

SUMMARY OF THE INVENTION

According to a first aspect of the present invention there is provided a grout fillable prop assembly comprising:

- a prop including an inner member and an overlapping outer member adapted for movement between a retracted configuration and an extended configuration;
- a unidirectional grout inlet through the prop to allow grout to pass to an interior of the prop; and

- a pressure relief valve in fluid communication with the interior of the prop;
- whereby in the extended position the prop is filled with grout via the unidirectional grout inlet until operation of the pressure relief valve.

Preferably the assembly includes an air conduit arranged to supply air to the interior of the prop whereby the prop is brought from the retracted configuration to the extended configuration by application of pressurized air through the air conduit.

In a preferred embodiment of the invention an air compressor is placed in communication with the air conduit.

The assembly may include a grout supply pump coupled to the unidirectional grout inlet.

Preferably the unidirectional grout inlet includes a one way valve in the form of a lay flat tube.

The end walls and adjacent sidewall portions of each of the inner member and outer member may have increased thicknesses relative to a remainder of the sidewalls of each of the inner and outer member.

In a preferred embodiment of the invention the pressure relieve valve has a predetermined release value 6 Bar though other pressures may be used and will be readily arrived at by those skilled in the art, taking into account factors such the amount of positive pressure required, the dimensions and weight of the prop and the type of grout used.

It is preferred that a peripheral seal runs between overlapping portions of the inner member and the outer member to assist in preventing egress of grout.

The seal may comprise an outwardly and upwardly extending flange around the outside of the inner member and integrally formed therewith.

According to a further aspect of the present invention there is provided a method for filling a telescopic ceiling support prop including the steps of:

- bringing the prop from a retracted configuration to an extended configuration wherein the prop abuts a ceiling to be supported;
- filling the prop in the extended configuration with grout to a predetermined pressure;
- allowing the grout to set while maintaining the predetermined pressure to thereby apply pressure to the ceiling subsequent to the setting of the grout.

The step of bringing the prop from a retracted configuration to an extended configuration preferably comprises filling the prop with pressurized air.

The step of filling the prop in the extended configuration with grout to a predetermined pressure may be achieved by placing a pressure release valve arranged to operate at the predetermined pressure in fluid communication with an interior of said prop.

The method may include monitoring for egress of grout through the pressure release valve and thereupon ceasing filling the prop with grout.

According to a further aspect of the invention there is provided a grout fillable prop assembly comprising

- an inner member and an outer member adapted for movement between a retracted configuration and an extended configuration;
- a unidirectional grout inlet in an upper part of a sidewall of the outer member to allow grout to pass into the prop, the inner member and the outer member having wall portions and being self-supporting;
- an air conduit through the prop having an opening adjacent an upper limit of the prop;
- a pressure relief valve coupled to the air conduit whereby the prop is brought from the retracted configuration to the extended configuration by application of pressurized air through the air conduit and whereby the extended prop is filled with grout via the unidirectional grout inlet.

BRIEF DESCRIPTION OF THE DRAWINGS

Preferred features, embodiments and variations of the invention may be discerned from the following Detailed Description which provides sufficient information for those skilled in the art to perform the invention.

The Detailed Description is not to be regarded as limiting the scope of the preceding Summary of the Invention in any way. The Detailed Description will make reference to a number of drawings as follows.

DETAILED DESCRIPTION OF PREFERRED EMBODIMENTS

Figure 1:
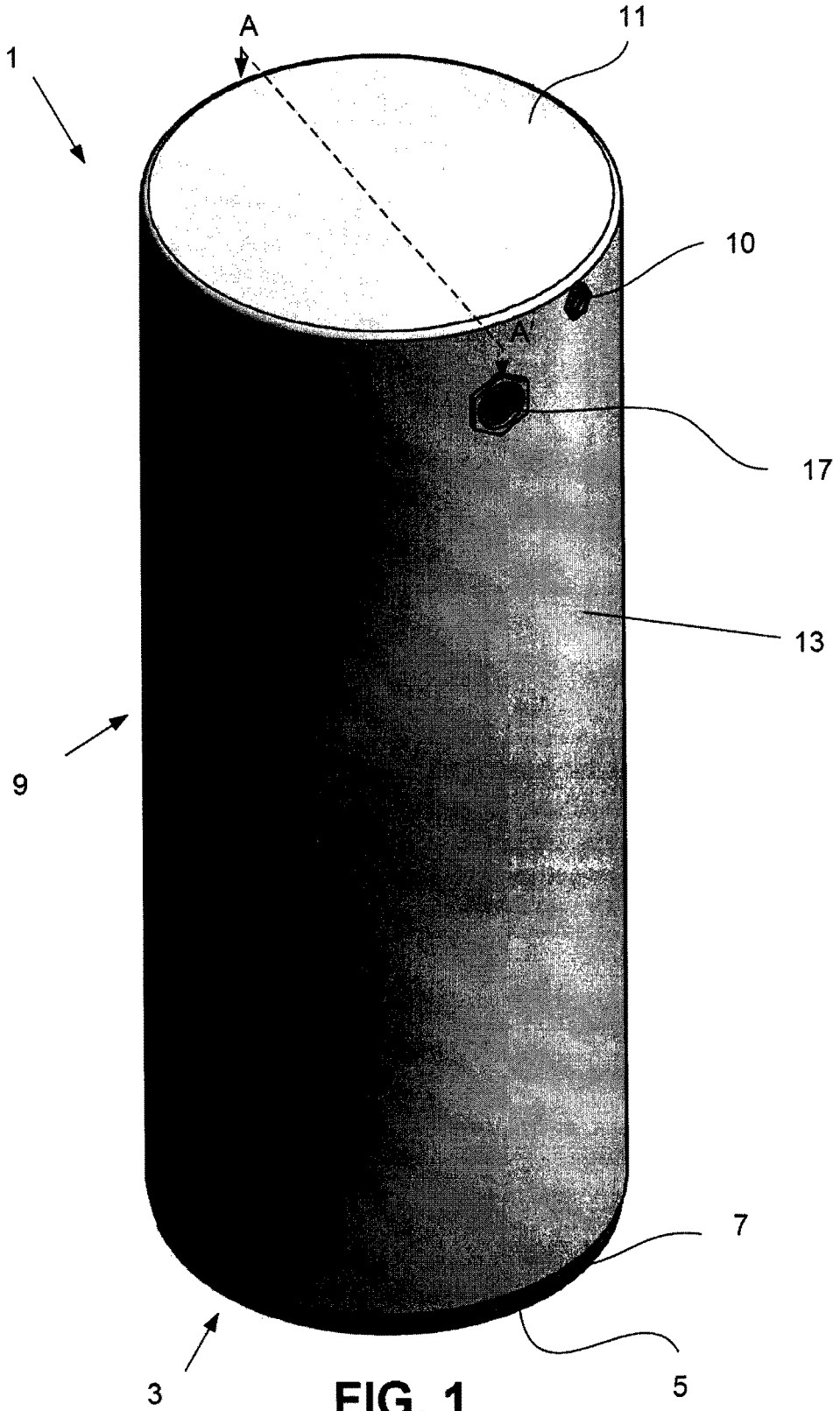
FIG. 1. is an isometric view of a telescopic prop in a retracted configuration according to a preferred embodiment of the invention.
Figures 3A, 3B:
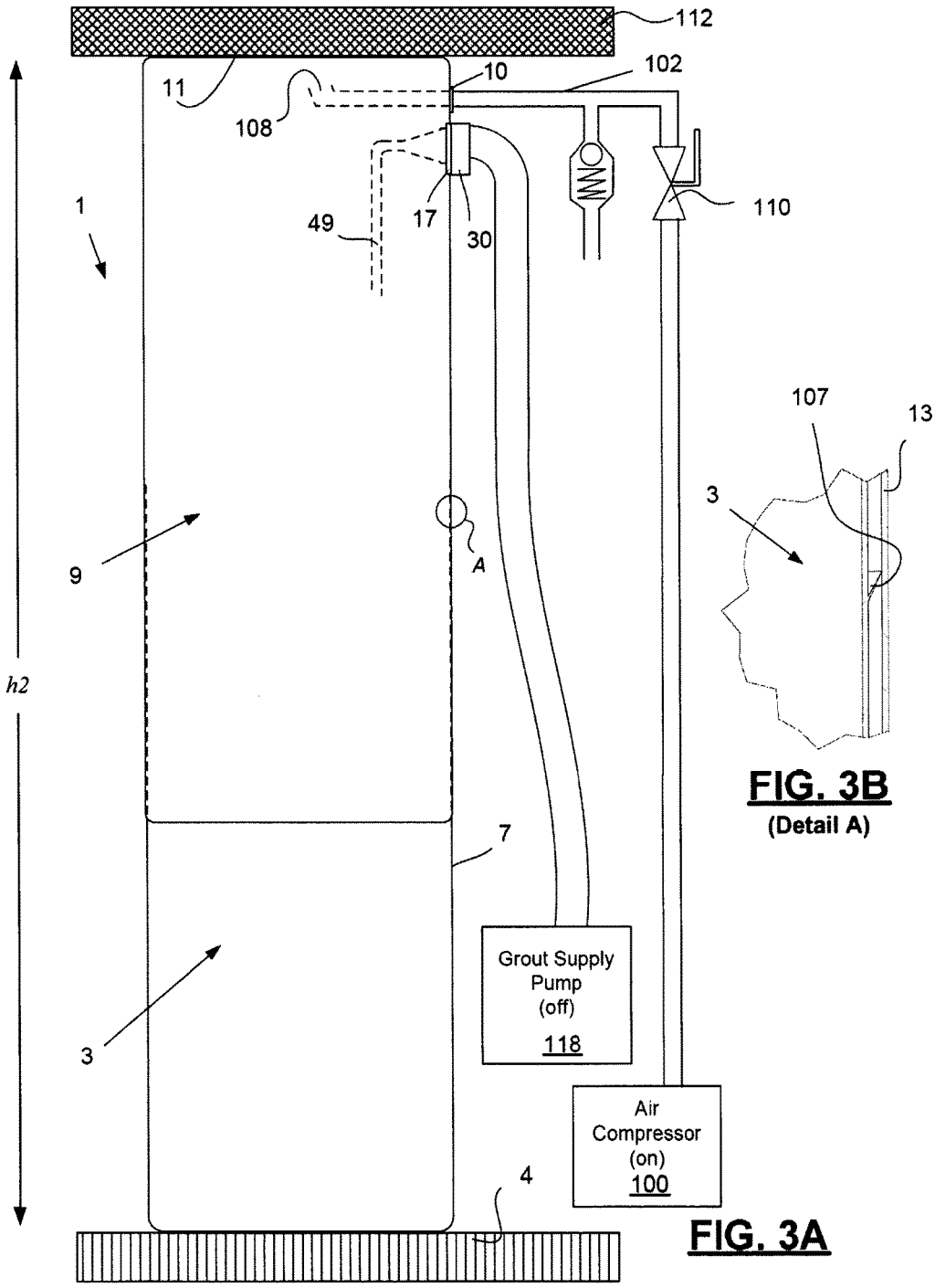
FIG. 3A is a side view, stylized, of the prop of FIG. 1 during a second stage of the method.
FIG. 3B is a detailed view of a portion of FIG. 3A showing an upwardly angled peripheral grout sealing flange of the inner member.

Referring now to FIG. 1 there is depicted a prop 1 according to preferred embodiment of the present invention in a retracted (collapsed) configuration located upon a floor 4. The prop 1 comprises an inner member 3 (better seen in FIG. 3A) having a bottom wall 5 and a side wall 7 over which there is located an outer member 9 or cover having a top wall 11 and a side wall 13. As best seen in FIG. 3B, a peripheral seal in the form of an upwardly angled, flange 107 runs around the outside circumference of the inner member 3 towards its upper limit. In use the flange 107 cooperates with the overlap between the upper and lower members to seal pressurised grout within the prop and to prevent it from egressing between the overlap of the inner and outer prop members.

Figure 2:
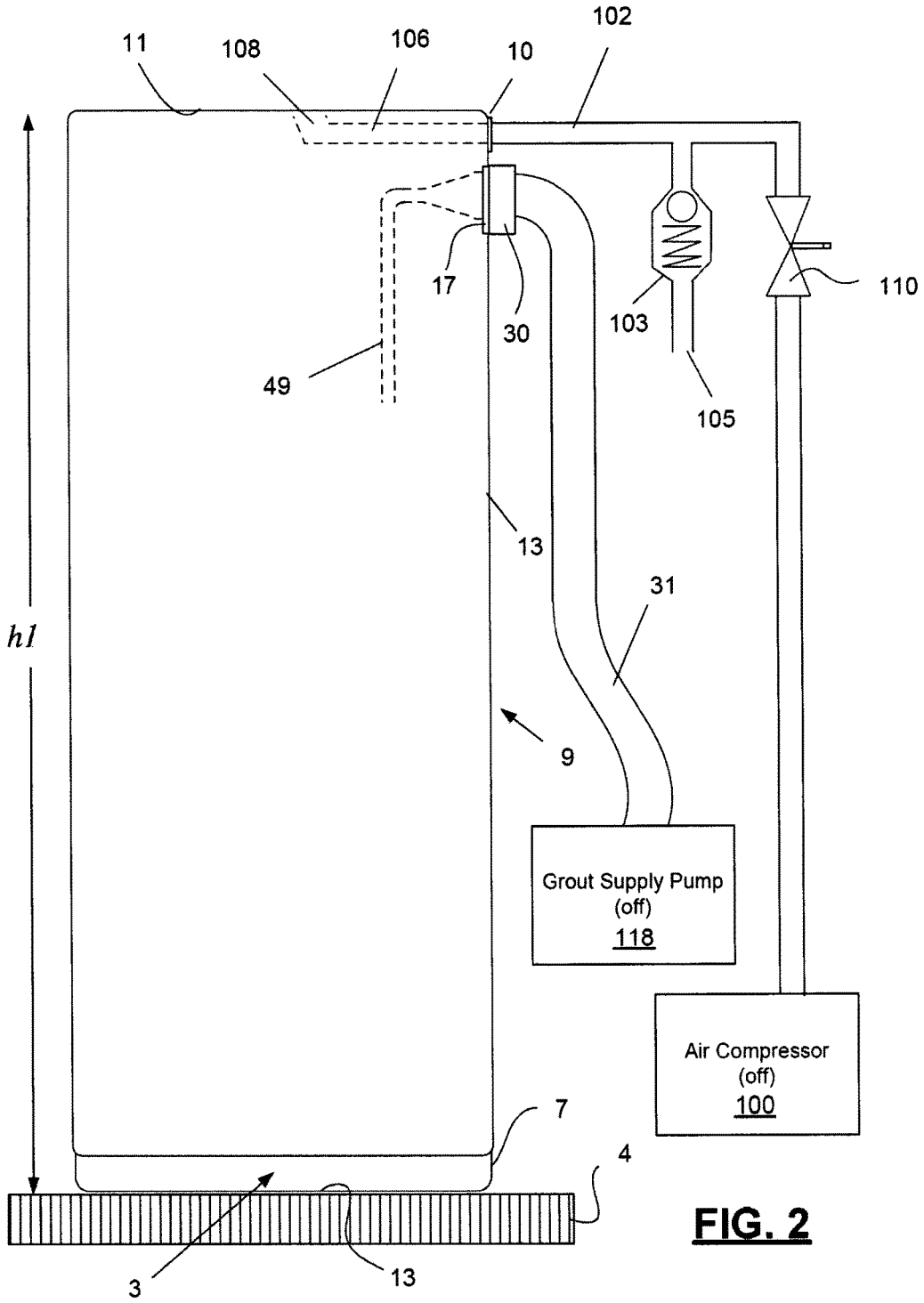
FIG. 2 is a side view, stylized, of the prop of FIG. 1 during a first stage of a method of use according to a preferred embodiment of the present invention.

With reference to FIG. 2 it will be seen that the side wall 13 of outer member 9 substantially overlaps the side wall 7 of inner member 3 so that the overall height of the prop in the retracted configuration shown in FIG. 2 is h1 as indicated whereas in the extended configuration shown in FIG. 3A it is h2 which is quite substantially greater than h1.

A grout inlet 17 is formed through side wall 13 of the cover to receive substantially non-compressible filler such as concrete or grout. Inlet 17 is located in an upper part of the side wall 13 of outer member 9. Inlet 17, in the particular embodiment, comprises a through hole and is adapted to receive an installation fitting 30 which is removable and which is coupled to a grout supply conduit 31.

The inner member 3 and outer member 9 preferably have wall portions with plastic properties and in the particular embodiment, the entire inner member and the entire outer member is made of the same plastic material. Various plastic materials are envisaged to provide plastic properties to the sidewalls 7, 13 of the inner member and the outer member. These plastic materials may include thermoplastics such as polythenes and particularly polyethylenes and polyhexenes. In the particular embodiment, the inner member 3 and the outer member 9 comprise a linear low density polyethylene such as MOCROLENE M11 UV R02 manufactured by Martogg & Company, Australia.

The various dimensions of the presently described exemplary embodiment will now be discussed. It will of course be realized that these are simply provided as non-limiting examples and other dimensions may be possible and preferred depending on the envisaged application.

Figure 3C:
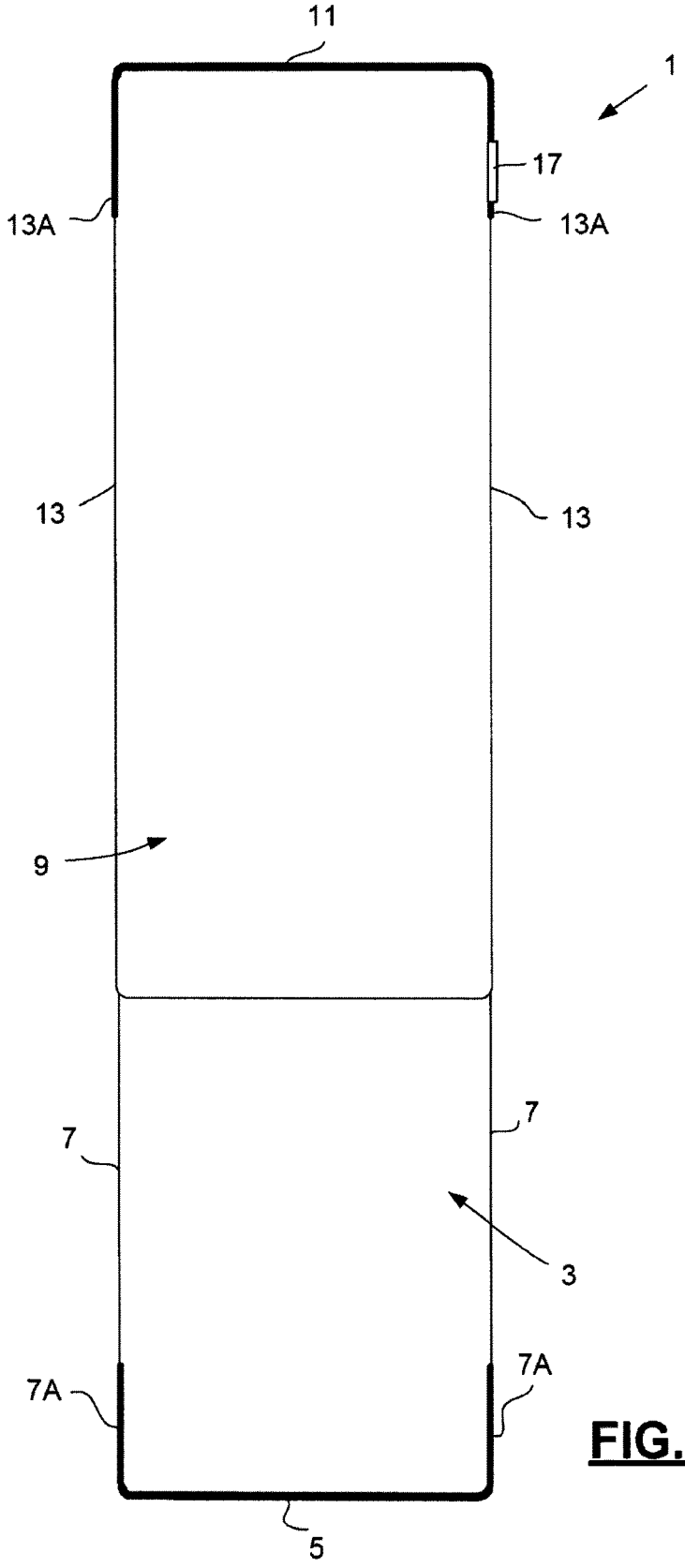
FIG. 3C is a plan view of a cross section through the prop along the line A-A' of FIG. 1 showing variations in wall thickness of the inner and outer members.

With reference to FIG. 3C which is a plan view of a cross section through the prop along the line A-A' of FIG. 1, the side wall 7 of inner member 3 can have a thickness of about 3.5 mm. In the presently described embodiment the bottom wall 5 has a thickness of about 10 mm and the portion 7*a* of the side wall 7, which is immediately above bottom wall 5 has a thickness of about 6 mm. This thicker sidewall portion 7*a* has a height of approximately 10-40 cm. The reason for thickening the sidewall will be described in greater detail below.

Each member is substantially identical in construction and therefore outer member 9 also has a side wall thickness of about 3.5 mm, top wall 11 has a thickness of about 10 mm and a portion 13*a* of wall 13 has a thickness of about 6 mm. The thicker side wall portion 13*a* is immediately below the top wall 11. Of course, the inner member 3 has a slightly smaller diameter to the outer member 9 to enable the inner member to slide inside the outer member between the retracted configuration and the extended configuration.

The above described arrangement of the thickened top and bottom walls and thickened side wall portions provides sufficient rigidity and strength to the inner member 3 and the outer member 9 to enable the members (and therefore the prop) to be self-supporting and not to simply collapse under its own weight prior to grout being pumped into the prop. Of course, an alternative would be to make the overall walls of each member thicker but that would use more material and is less preferred. The 6 mm thicker upper side wall portion 13*a* coincides with grout inlet 17 which means that the wall defining inlet 17 has a thickness of 6 mm this making it more suitable for attachment by the installation fitting 30 which will be described in greater detail below.

In this particular embodiment, each member has a length of approximately 2 m and a diameter of about 900 mm. When extended (see FIG. 3) there will be an overlap between the upper end of the inner member 3 and the lower end of the outer member 9, and this overlap will be about 800 mm in the presently described embodiment.

The overlap and the peripheral sealing flange 107 prevent grout exiting the prop between the inner member and the outer member.

Reference will now be made to the improved filling of the prop, and in particular reference will be made to FIGS. 2-7. Referring again to FIG. 2, there is illustrated an installation fitting 30 which is coupled to the grout inlet 17.

The grout inlet 17 may be initially taped over by a removable tape to prevent dirt and debris from entering into inlet 17 and also to prevent the inlet from being damaged. The prop (comprising the outer member 9 and the inner member 3) is carried by two workers into the required position, shown in FIG. 2, while the prop is in the collapsed state.

The upper member 9 is also formed with an air port 10 therethrough. An air compressor 100 is coupled to the air port 10 via conduit 102. An air supply valve 110 is placed in line in the conduit 102. A pressure relief valve 103 (or as it is often referred to herein simply a "relief valve") is also coupled to the conduit 102 and hence to the air port 10. Accordingly the air pressure relief valve is in fluid communication with the air conduit. The relief valve 103 is configured to be in a closed state until the pressure on the air port 10 side of the valve 103 is at least a predetermined amount higher than on the outlet side 105 of the relief valve. In one embodiment of the invention the predetermined release pressure is 6 psi though obviously other values may be used depending on the desired operating characteristics of the system.

Internally, the air port 10 is coupled to a pipe 106 which has an opening 108 that is adjacent the upper internal wall 11 of the upper prop member 9.

Referring now to FIG. 3A, the air compressor 100 is turned on and the air supply valve 110 is opened to allow the air to flow from the compressor, through valve 110, though air port 10 and out of the opening 108 into the prop 1. Since the pressure across the relief valve 103 is less than the predetermined release value the relief valve 103 assumes a closed configuration.

As the air from the compressor 100 enters the prop it causes the upper prop member 9 to rise until its top wall 11 abuts the ceiling 112.

Figure 4:
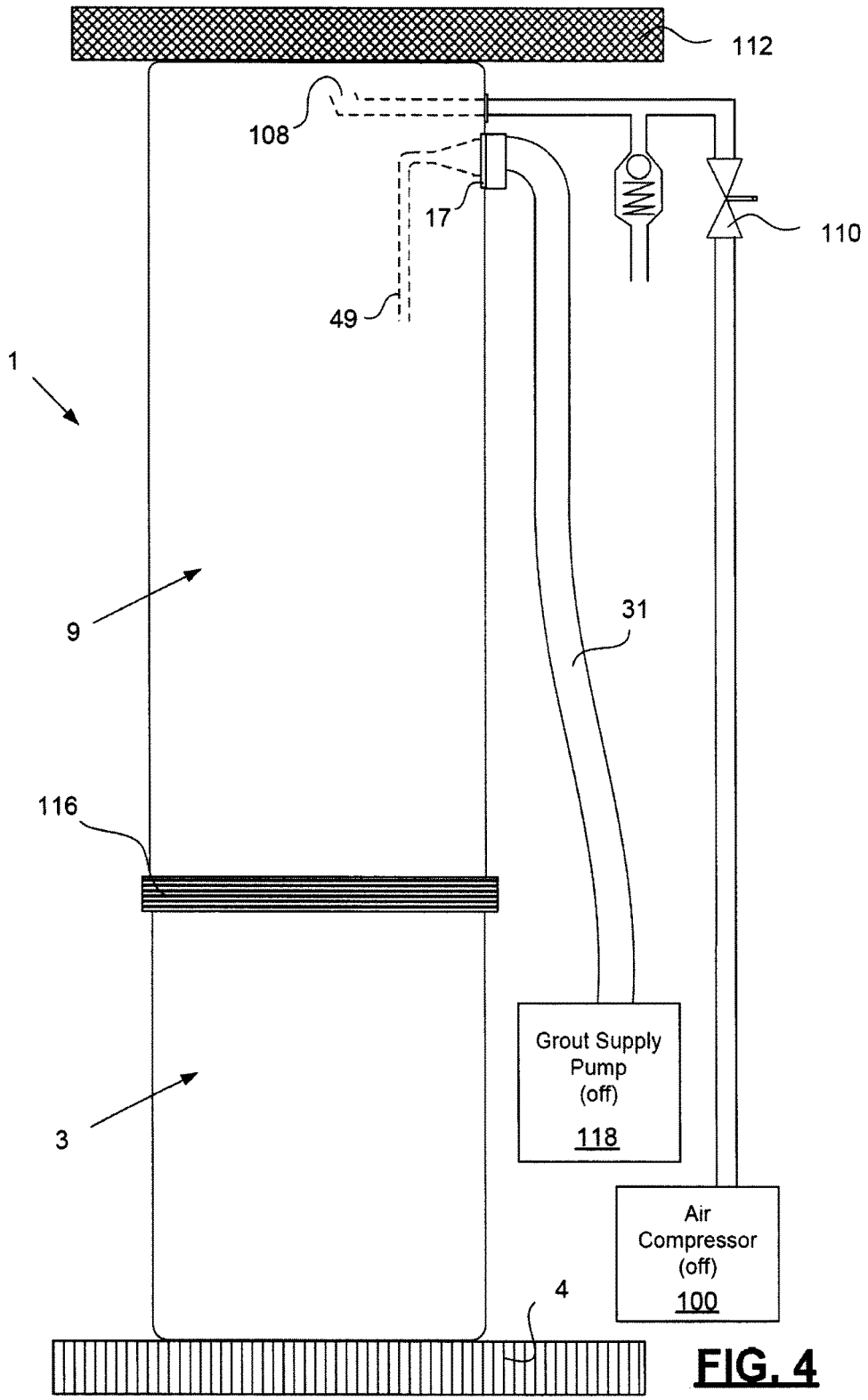
FIG. 4 is a side view, stylized of the prop of FIG. 1 during a third stage of the method.

Once the upper prop 9 has abutted the ceiling 112 a suitable retaining arrangement for example duct tape 116, may be placed around the join between the upper prop member 9 and the lower prop member 7 as shown in FIG. 4.

The air compressor 100 is then disconnected or turned off and the air supply valve 110 is closed as also shown in FIG. 4.

Figure 5:
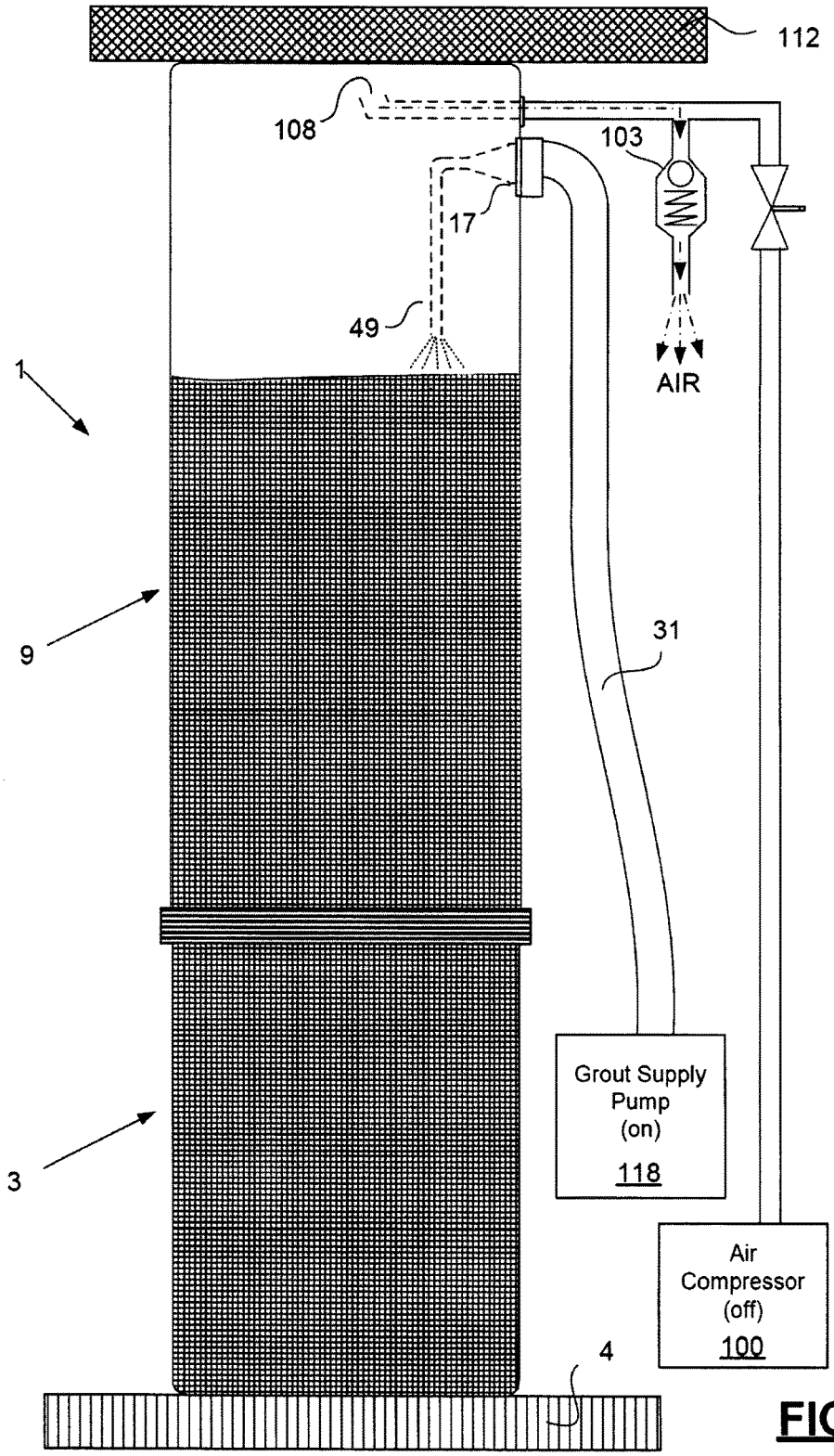
FIG. 5 is a side view, stylized of the prop of FIG. 1 during a fourth stage of the method.

Referring now to FIG. 5, grout supply pump 118 is then switched on so that grout flows through grout conduit 31, through grout inlet 17, through internal one-way valve 49 and thence into the interior of prop 1.

The one-way valve 49, in the present embodiment, comprises a length of lay flat plastic tube. One end of the plastic is attached to the inside portion of the grout inlet 17. In other embodiments it could instead have one end of the plastic tube attached to the inside portion of the installation fitting 30.

Consequently, the grout inlet 17 is unidirectional since while grout can pass through it into the prop grout is prevented from passing back out due to the one-way valve 49.

In the presently described embodiment the one-way valve comprises a length of lay flat plastic having a diameter of about 100 mm and a length of about 30 cm.

As grout is pumped into the prop, as shown in FIG. 5, it travels through the lay flat plastic tube 49 and causes the plastic tube to be inflated. As soon as the pumping stops, the plastic returns back to the deflated normal flat position stopping the reverse flow of the grout. Another advantage of the lay flat plastic tube 49 is that it causes the grout to flow down into the prop for even filling as opposed to being shot against the opposite wall of the prop. When the prop is filled, the plastic 49 and installation fitting 30 may be left to remain with the prop and the plastic one-way tube that comprises valve 49 becomes embedded in the grout.

The plastic one-way valve 49 also functions as a one-way valve during the earlier use of compressed air to extend the prop thereby preventing air exiting through port 17 as the pressurized air is applied through port 10.

The prop can be filled with a suitable grout material. The flow rate is approximately 165 L per minute although this can vary to suit. This enables the prop to be filled in approximately 12 min. This of course can vary and it is envisaged that different customers will have different requirements for the amount of weight that the prop need to hold for a desired amount of time and this can vary and so too the make up or strength of the grout to suit. A non-limiting grout that may be suitable for some applications, such as in underground mine ceiling support, is CMT Grout 1:1 water/powder ratio manufactured by Minova Australia.

During the grout filling process air is forced back through the opening 108. Since the air is under greater pressure than the release pressure value of the relief valve 103, the air proceeds out through the relief valve 103. Accordingly, the exhaust of all air pockets within the prop is achieved via the relief valve 103.

Figure 6:
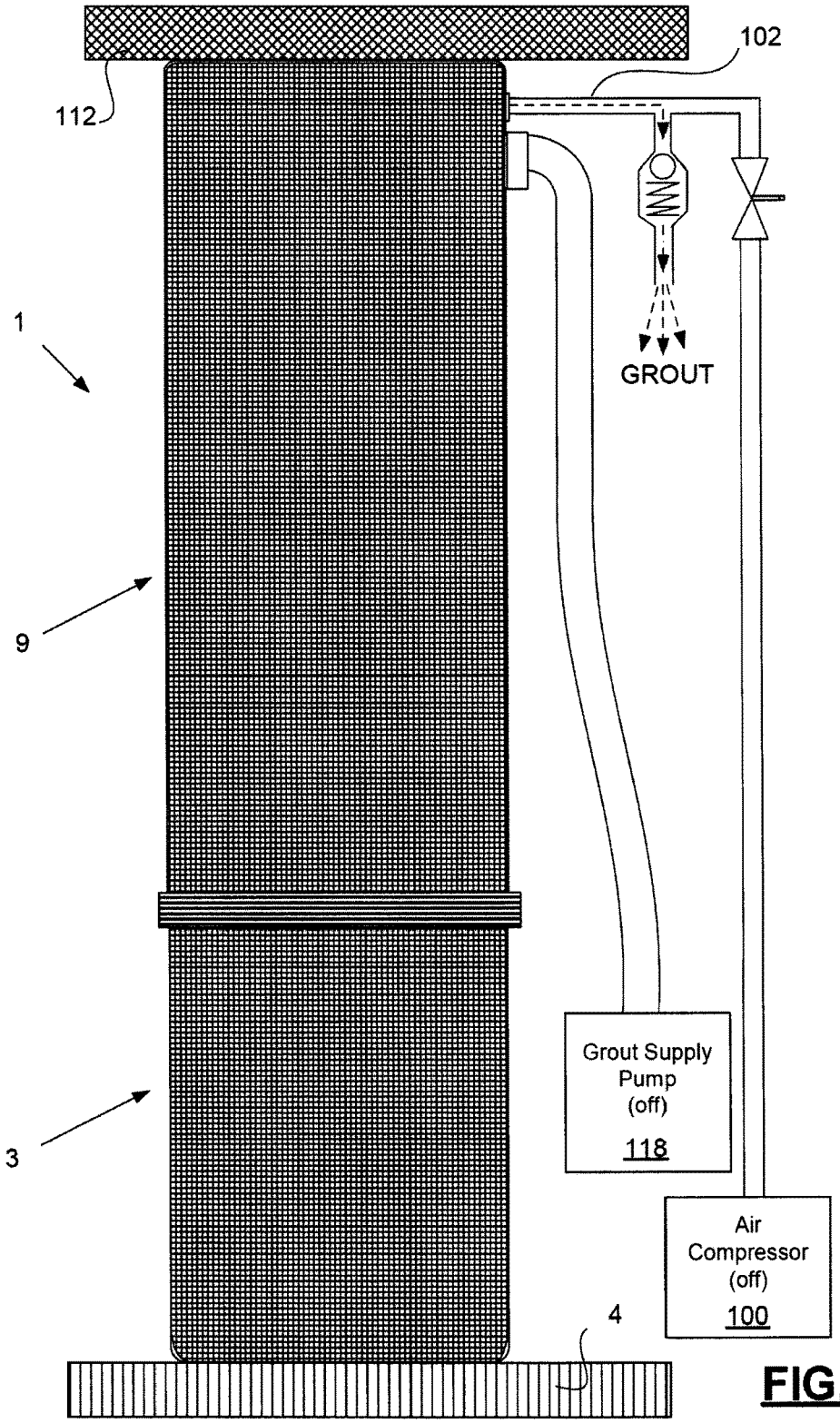
FIG. 6 is a side view, stylized of the prop of FIG. 1 during a fifth stage of the method.
Figure 7:
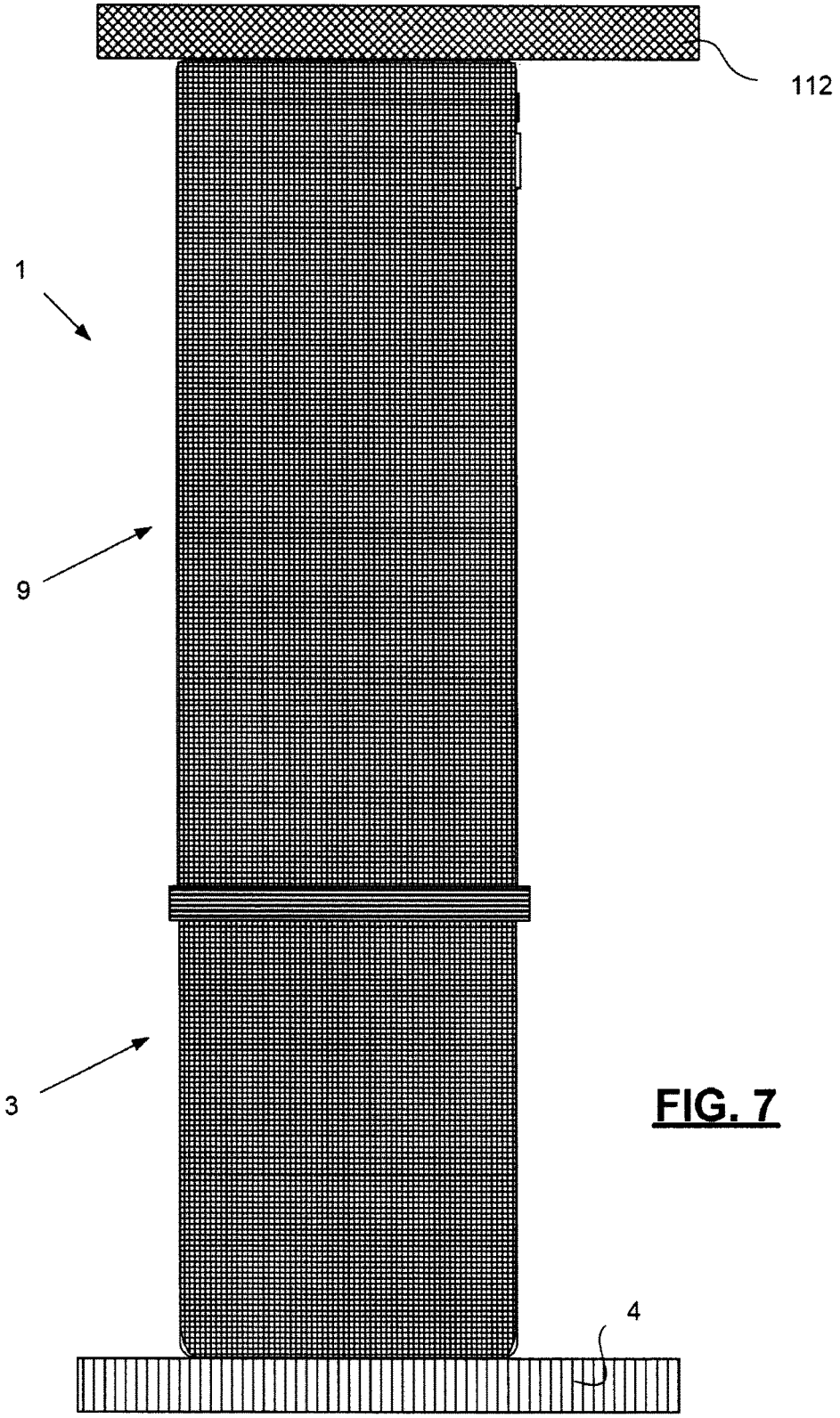
FIG. 7 is a side view, stylized of the prop of FIG. 1 in an extended configuration and exerting positive pressure between a floor and ceiling subsequent to performance of the method.

As the prop continues to be filled with grout it reaches the top of the upper prop member as shown in FIG. 6. At that point some grout enters the opening 108 and then travels out of the prop, through conduit 102 and egresses out of the pressure relief valve 103 thereby providing a visual confirmation that the prop is full of grout. The predetermined release pressure value of the relief valve 103 ensures that the prop is protected from being over pressurised by the grout filling process while providing a specific amount of back pressure. Accordingly, the relief valve 103 ensures that a positive pressure is applied by the prop to the ceiling 112 which is maintained as the grout sets to assume the final configuration shown in FIG. 7. It may sometimes be more time efficient to leave the fitting 30, relief valve 103 and air valve 110 in place fitted to the prop rather than remove them as shown in FIG. 7.

Since the grout within the prop 1 sets while pressurized the inner and outer prop members continue to exert force against the ground and ceiling 112 respectively. Accordingly, the ceiling integrity and delamination problem that was discussed earlier is addressed.

Where it is envisaged that the prop be used in a mining environment it will preferably be made of, or treated with, an anti-static material.

It will be realized that it is most convenient to bring the prop from the retracted configuration to the extended configuration by applying pressurized air as has been explained. However, in other embodiments the prop could be brought to the extended configuration by manually lifting the outer member 9. The filling of the prop with the grout so that the prop exerts positive pressure on the ceiling would then proceed in the fashion that has previously been described.

In compliance with the statute, the invention has been described in language more or less specific to structural or methodical features.

The term "comprises" and its variations, such as "comprising" and "comprised of" is used throughout in an inclusive sense and not to the exclusion of any additional features.

It is to be understood that the invention is not limited to specific features shown or described since the means herein described comprises preferred forms of putting the invention into effect.

The invention is, therefore, claimed in any of its forms or modifications within the proper scope of the appended claims appropriately interpreted by those skilled in the art.

The invention claimed is:

1. A grout fillable prop assembly comprising:

a prop including an inner member and an overlapping outer member adapted for movement between a retracted configuration and an extended configuration, each said inner member and outer member being self-supporting;

a peripheral sealing flange extending between overlapping portions of the inner member and the outer member, the peripheral sealing flange being an upwardly angled flange formed on an outside of the inner member;

a unidirectional grout inlet through the prop to allow grout to pass to an interior of the prop;

an air conduit arranged to supply air to the interior of the prop; and a pressure relief valve in fluid communication with the interior of the prop;

whereby the prop is brought from the retracted configuration to the extended configuration by application of pressurized air through the air conduit and whereby in the extended configuration the prop is filled with grout via the unidirectional grout inlet until operation of the pressure relief valve.

2. The assembly according to claim 1, wherein an air compressor is placed in communication with the air conduit.

3. The assembly according to claim 2, wherein an air supply valve is located between the air compressor and an outlet of the conduit for selectively isolating the air compressor from the outlet.

4. The assembly according to claim 1, her comprising a grout supply pump coupled to the unidirectional grout inlet.

5. The assembly according to claim 1, wherein the unidirectional grout inlet includes a one way valve in the form of a lay flat tube.

6. The assembly according to claim 1, wherein end walls and adjacent sidewall portions of each of the inner member and outer member have increased thicknesses relative to a remainder of the sidewalls of each of the inner and outer member.

7. The assembly according to claim 1, wherein the pressure relief valve has a predetermined release value of 6 psi.

8. The assembly according to claim 1, wherein when the prop is in the extended configuration between a floor and a ceiling; the prop applies a positive pressure to the ceiling until after the grout has set.

9. The assembly according to claim 1, wherein the inner member and the outer member are made from a plastic material.

10. The assembly according to claim 1, wherein the inner member and the outer member are made from polyethylene or polyhexene.

11. The assembly according to claim 1, wherein the peripheral sealing flange increases a rigidity of the inner member.

12. The assembly according to claim 1, wherein the inner member and the outer member are each substantially cylindrical, and wherein the prop has a substantially constant cross-section perpendicular to a movement direction.

13. A method for filling a telescopic ceiling support prop, comprising:

reconfiguring the prop from a retracted configuration to an extended configuration by filling the prop with pressurized air, wherein reconfiguring the prop involves an inner member moving telescopingly relative to an overlapping outer member while maintaining an air tight seal therebetween via an upwardly angled flange extending outwardly from the inner member to the outer member, the prop continuing to be extended until the prop abuts a ceiling to be supported;

filling the prop in the extended configuration with grout to a predetermined pressure by placing a pressure release valve arranged to operate at the predetermined pressure in fluid communication with an interior of said prop; and allowing the grout to set while maintaining the predetermined pressure to thereby apply pressure to the ceiling subsequent to the setting of the grout.

14. The method according to claim 13, including monitoring for egress of grout through the pressure release valve and thereupon ceasing filling the prop with grout.

15. A grout fillable prop assembly comprising:

an inner member and an outer member adapted for telescoping movement between a retracted configuration and an extended configuration, the inner member and the outer member having overlapping wall portions that overlap each other, each said inner member and outer member being self-supporting;

a peripheral sealing flange extending between overlapping wall portions of the inner member and the outer member, the peripheral sealing flange being an upwardly angled flange extending outwardly and upwardly from the inner member towards the outer member;

a unidirectional grout inlet in an upper part of a sidewall of the outer member to allow grout to pass into the prop;

an air conduit through the prop having an opening adjacent an upper limit of the prop; and a pressure relief valve coupled to the air conduit, whereby the prop is brought from the retracted configuration to the extended configuration by application of pressurized air through the air conduit and whereby the prop in the extended configuration is filled with grout via the unidirectional grout inlet.

16. The assembly according to claim 15, wherein the inner member is formed of a flexible material, and wherein the peripheral sealing flange decreases a flexibility of the inner member to assist in retaining a peripheral shape of the inner member.

* * * * *